US010237666B2

(12) United States Patent
Gan et al.

(10) Patent No.: US 10,237,666 B2
(45) Date of Patent: Mar. 19, 2019

(54) PORTABLE ELECTRONIC DEVICE WITH ACOUSTIC AND/OR PROXIMITY SENSORS AND METHODS THEREFOR

(71) Applicant: Google Technology Holdings LLC, Mountain View, CA (US)

(72) Inventors: Su-Yin Gan, San Francisco, CA (US); Alex Vaz Waddington, San Jose, CA (US)

(73) Assignee: Google Technology Holdings LLC, Mountain View, CA (US)

( * ) Notice: Subject to any disclaimer, the term of this patent is extended or adjusted under 35 U.S.C. 154(b) by 10 days.

(21) Appl. No.: 15/848,843

(22) Filed: Dec. 20, 2017

(65) Prior Publication Data

US 2018/0115846 A1 Apr. 26, 2018

Related U.S. Application Data

(63) Continuation of application No. 14/301,417, filed on Jun. 11, 2014, now Pat. No. 9,883,301.

(60) Provisional application No. 61/982,371, filed on Apr. 22, 2014.

(51) Int. Cl.
*H04R 29/00* (2006.01)

(52) U.S. Cl.
CPC ..... *H04R 29/00* (2013.01); *H04R 2499/11* (2013.01)

(58) Field of Classification Search
CPC ..... H04R 29/00; H04R 2499/10; H04R 2499/11; H04R 2499/15; H04M 1/72538; H04M 1/72563; H04M 1/72569; H04M 2250/12; H04M 2250/22
USPC ..... 381/56
See application file for complete search history.

(56) References Cited

U.S. PATENT DOCUMENTS

| | | | |
|---|---|---|---|
| 6,532,447 | B1 | 3/2003 | Christensson |
| 8,560,004 | B1 | 10/2013 | Tsvetkov et al. |
| 8,621,583 | B2 | 12/2013 | Yang et al. |
| 2012/0050007 | A1 | 3/2012 | Forutanpour et al. |

(Continued)

FOREIGN PATENT DOCUMENTS

WO 2013168171 A1 11/2013

OTHER PUBLICATIONS

Prosecution History from U.S. Appl. No. 14/301,417, dated Sep. 28, 2016 through Nov. 15, 2017, 64 pp.

*Primary Examiner* — Ahmad F. Matar
*Assistant Examiner* — Sabrina Diaz
(74) *Attorney, Agent, or Firm* — Shumaker & Seiffert, P.A.

(57) ABSTRACT

An electronic device includes a housing and a user interface. The electronic device also includes an acoustic detector and one or more processors operable with the acoustic detector. The one or more processors can receive, from the user interface, user input corresponding to an operation of the electronic device. The one or more processors can then optionally initiate a timer in response to receiving the user input and monitor the acoustic detector for a predefined acoustic marker, one example of which is acoustic data indicating detection of one or more finger snaps. Where the one or more finger snaps occur prior to expiration of the timer, the one or more processors can perform the operation of the electronic device. Otherwise ignore the user input. The acoustic confirmation of user input helps to eliminate false triggers, thereby conserving battery power and extending run time.

16 Claims, 5 Drawing Sheets

(56) References Cited

U.S. PATENT DOCUMENTS

| | | | | |
|---|---|---|---|---|
| 2012/0249741 | A1* | 10/2012 | Maciocci | G06F 3/011 348/46 |
| 2013/0106686 | A1 | 5/2013 | Bennett | |
| 2013/0127712 | A1 | 5/2013 | Matsubayashi | |
| 2013/0325479 | A1 | 12/2013 | Krueger et al. | |
| 2014/0139637 | A1 | 5/2014 | Mistry et al. | |
| 2014/0222436 | A1* | 8/2014 | Binder | G06F 3/167 704/275 |
| 2015/0148923 | A1 | 5/2015 | Grimme et al. | |
| 2015/0279369 | A1* | 10/2015 | Lee | G06K 9/00288 704/275 |
| 2015/0304785 | A1 | 10/2015 | Gan et al. | |

* cited by examiner

PORTABLE ELECTRONIC DEVICE WITH ACOUSTIC AND/OR PROXIMITY SENSORS AND METHODS THEREFOR

CROSS REFERENCE TO PRIOR APPLICATIONS

This application is a continuation of U.S. application Ser. No. 14/301,417, filed Jun. 11, 2014, which claims the benefit of U.S. Provisional Application No. 61/982,371, filed Apr. 22, 2014, the entire contents of each of which are hereby incorporated by reference.

BACKGROUND

Technical Field

This disclosure relates generally to electronic devices, and more particularly to portable electronic devices having acoustic and/or proximity sensors.

Background Art

Portable electronic devices are continually becoming more advanced. Simple cellular telephones with 12-digit keypads have evolved into "smart" devices with sophisticated touch-sensitive screens. These smart devices are capable of not only making telephone calls, but also of sending and receiving text and multimedia messages, surfing the Internet, taking pictures, and watching videos, just to name a few of their many features.

Advances in technology do not always result in the elimination of problems, however. Illustrating by example, sophisticated touch-sensitive displays are capable of being actuated by a variety of devices. More than once a smart device user has "pocket dialed" an unintended party when an object in their pocket has caused a false activation of the touch-sensitive screen to place a telephone call to a person without the knowledge of the smart device's owner. In an attempt to combat this and other "false trip" situations, designers have added complex locking mechanisms that require a multitude of gestures or user manipulations to unlock the device prior to use. While such locking mechanisms can work, the many gestures and user input manipulations required take time. Consequently, a person may miss taking a picture of their child's first steps simply because they could not get their smart device unlocked. It would be advantageous to have an improved device and/or method to reduce the occurrence of false activation of user interfaces.

Figure 1:
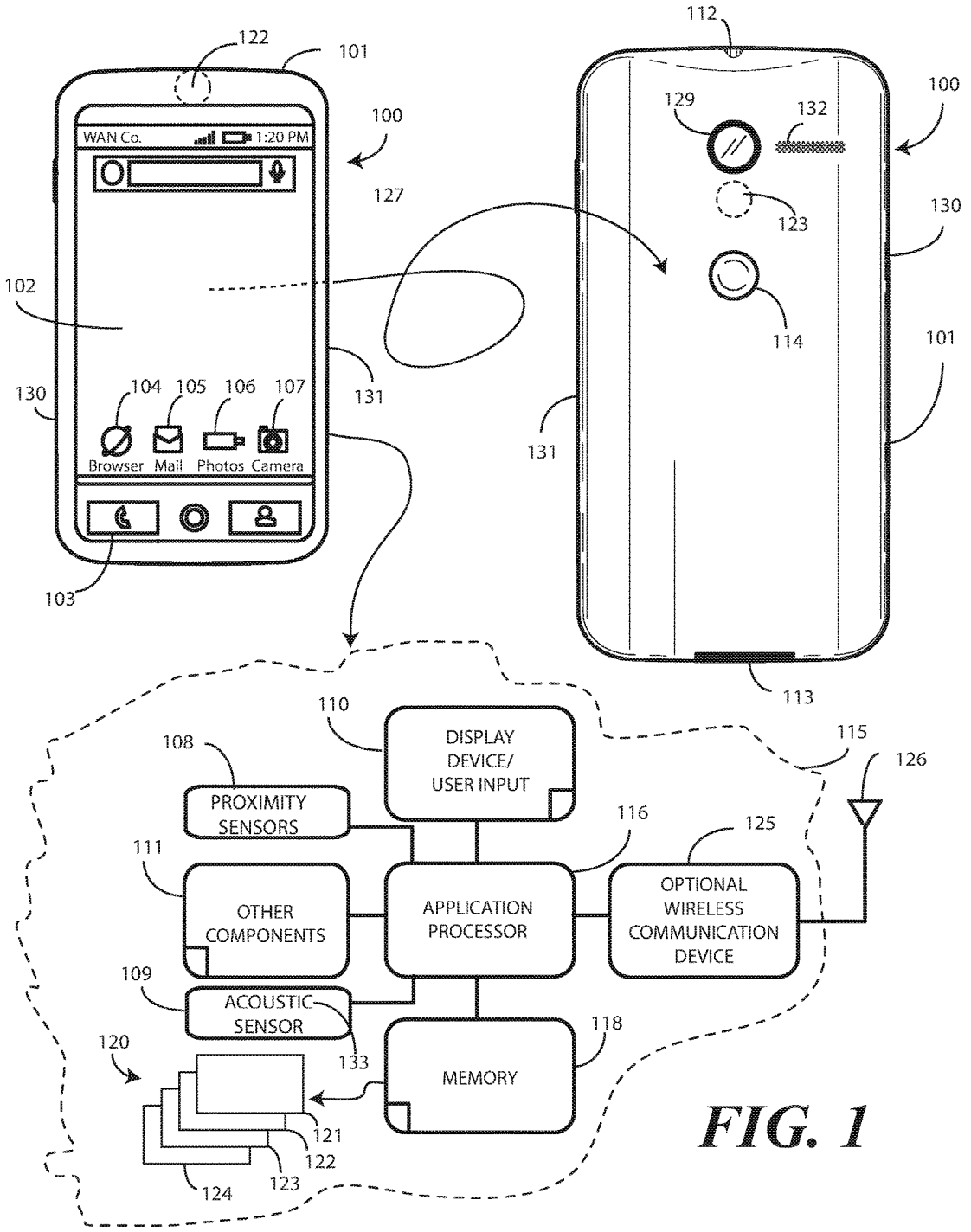
FIG. 1 illustrates one explanatory portable electronic device in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Before describing in detail embodiments that are in accordance with the present disclosure, it should be observed that the embodiments reside primarily in combinations of method steps and apparatus components related to receive user input and confirm that user input with a predefined acoustic signal. Any process descriptions or blocks in flow charts should be understood as representing modules, segments, or portions of code which include one or more executable instructions for implementing specific logical functions or steps in the process. Alternate implementations are included, and it will be clear that functions may be executed out of order from that shown or discussed, including substantially concurrently or in reverse order, depending on the functionality involved. Accordingly, the apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

It will be appreciated that embodiments of the disclosure described herein may be comprised of one or more conventional processors and unique stored program instructions that control the one or more processors to implement, in conjunction with certain non-processor circuits, some, most, or all of the functions of confirming user input with predefined acoustic signaling to prevent false tripping of user interfaces as described herein. The non-processor circuits may include, but are not limited to, a radio receiver, a radio transmitter, signal drivers, clock circuits, power source circuits, and user input devices. As such, these functions may be interpreted as steps of a method to perform the confirmation of user input with the receipt of predefined acoustic patterns, such as that provided by one or more snaps. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a mechanism for reducing the false triggering of user input. In one or more embodiments, a combination of user proximity to an electronic device, combined with the delivery of one or more acoustic signals, is required to deliver user input—or confirm that user input has been delivered. For example, in one embodiment, an electronic device includes one or more proximity sensors that detect an approaching user's hand. When the hand is detected as approaching the electronic device, one or more processors of the electronic device initiate a timer. An acoustic sensor then listens for a predefined acoustic signal, such as one or more finger snaps. Where the predefined acoustic signal is received prior to expiration of the timer, this proximity/acoustic signal combination can be used to actuate an operation in the electronic device such as activating a display.

In another embodiment, the predefined acoustic signal can be used to negate or cancel real or perceived user input received by the electronic device. For instance, a false trigger may cause the electronic device to enter a telephone mode of operation to place a call. Where the user has configured the predefined acoustic signal for negation, the acoustic sensor can listen for the predefined acoustic signal prior to the expiration of the timer. The user can simply snap their fingers, clap their hands, whistle, or make a sound corresponding to the predefined acoustic signal to cancel the operation. Similarly, if the user is delivering voice commands to the electronic device, and those voice commands are not properly understood by the electronic device, the user can cancel the erroneous operation by delivering the predefined acoustic signal where the electronic device is configured in accordance with this embodiment.

In one or more embodiments, the proximity/acoustic signal user input combination can be used to actuate an "always-on display." Embodiments of the disclosure contemplate that the methods and systems described below can be used with an electronic device that employs an "always-on display." An always-on display can present information to a user both when the electronic device is in an active mode and when the electronic device is in a low-power or sleep mode. For example, when the electronic device is in the active mode, the always-on display may actively be displaying photographs, web pages, phone or contact information, or other information. When the electronic device is in a low-power or sleep mode, the always-on display may present supplementary information on a persistent basis to a user, such as the time of day, a particular photograph, or calendar events from the day.

In one or more embodiments, the always-on display is touch sensitive. Accordingly, when the electronic device is in the low-power or sleep mode, touch input along the always-on display can be used to transition the electronic device from the low power or sleep mode to an active mode of operation. Embodiments of the disclosure contemplate that, by using an always-on display, false triggers resembling user input can repeatedly cause the electronic device to wake up and power all processors, which consumes large amounts of current and reduces overall run time by depleting energy stored in the battery. Embodiments of the disclosure can be used to extend battery life by requiring both proximity detection and acoustic signal detection prior to returning the electronic device to the active mode of operation.

Thus, in one embodiment, one or more processors of an electronic device are configured to receive sensor data from one or more proximity sensor components. The sensor data can correspond to an object, such as the user's hand, approaching the housing of the electronic device. When this occurs, the one or more processors can initiate a timer in response to the object approaching the housing. The one or more processors can then monitor an acoustic detector of the electronic device for acoustic data corresponding to a predefined acoustic marker. In one embodiment, the predefined acoustic marker comprises one or more finger snaps. Where the acoustic marker is received prior to expiration of the timer, the one or more processors can perform an operation of the electronic device. Otherwise, any received user input can be ignored to save battery capacity and extend device run time.

The acoustic signaling detected by the acoustic sensor can be used in other ways as well. For example, in one embodiment, the acoustic sensor can monitor ambient noise. When ambient noise is elevated, such as when measured ambient noise exceeds a threshold level, one or more processors of an electronic device can require confirmation that user input has been delivered in the form of a predefined acoustic signal. This helps reduce the chance that, for instance, when user input is delivered in the form of voice commands, false triggers will unnecessarily actuate the electronic device. For example, in a crowded and noisy bar it is easy to contemplate someone saying, "What time is it?" When that occurs, electronic devices configured in accordance with embodiments of the disclosure can distinguish between random noise and voice commands by requiring confirmation with the receipt of a predefined acoustic signal before performing any operation.

Thus, in one embodiment, one or more processors of an electronic device can receive ambient noise data from an acoustic detector of the electronic device. The one or more processors can also receive user input corresponding to an operation of the electronic device. The user input may be touch input, or alternatively, may comprise voice input. To determine whether the electronic device is in a noisy environment, the one or more processors can compare the ambient noise data to a noise threshold. Where an ambient noise level of the ambient noise data is above the noise threshold, the one or more processors can monitor the acoustic detector for acoustic data indicating detection of a predefined acoustic marker or signal. In one embodiment, the predefined acoustic marker or signal comprises one or more finger snaps. Where the one or more finger snaps occurs, the one or more processors can perform the operation of the electronic device. Otherwise, the one or more processors can ignore the user input to conserve battery capacity and extend runtime.

In a more generic embodiment, one or more processors of an electronic device can require receipt of a predefined acoustic marker to confirm that user input is received. (Alternatively, the receipt of the predefined acoustic marker can also cancel user input in another embodiment, as noted above.) This requirement of receipt of a secondary marker helps to reduce false tripping as well. For instance, in one embodiment, one or more processors of an electronic device can receive, from the user interface, user input corresponding to an operation of the electronic device. When the user input is received, the one or more processors can initiate a timer in response to receiving the user input. The one or more processors can then monitor the acoustic detector for acoustic data indicating detection of a predefined acoustic marker or signal, such as one or more finger snaps. Where the one or more finger snaps occurs prior to expiration of the timer, the one or more processors can perform the operation of the electronic device. Otherwise, the one or more processors can ignore the user input. The above examples of uses for methods and systems of embodiments of the disclosure are illustrative only, as others will be obvious to those of ordinary skill in the art having the benefit of this disclosure.

Turning now to FIG. 1, illustrated therein is one explanatory electronic device 100 configured in accordance with one or more embodiments of the disclosure. The electronic device 100 of FIG. 1 is a portable electronic device, and is shown as a smart phone for illustrative purposes. However, it should be obvious to those of ordinary skill in the art having the benefit of this disclosure that other electronic devices may be substituted for the explanatory smart phone of FIG. 1. For example, the electronic device 100 could equally be a palm-top computer, a tablet computer, a gaming device, a media player, or other device.

This illustrative electronic device 100 includes a display 102, which may optionally be touch-sensitive. In one embodiment where the display 102 is touch-sensitive, the display 102 can serve as a primary user interface of the electronic device 100. Users can deliver user input to the display 102 of such an embodiment by delivering touch input from a finger, stylus, or other objects disposed proximately with the display. In one embodiment, the display 102 is configured as an active matrix organic light emitting diode (AMOLED) display. However, it should be noted that other types of displays, including liquid crystal displays, would be obvious to those of ordinary skill in the art having the benefit of this disclosure.

In one embodiment, the display 102 is an "always-on" display. This means that when the electronic device 100 is in an active mode of operation, the display 102 is active and is presenting content to a user. However, when the electronic device 100 is in a low-power or sleep mode, at least a portion of the display 102 is able to present persistent information. Illustrating by example, when the display 102 is an always-on display, and the electronic device 100 is in a low-power or sleep mode, perhaps a quarter of the display 102 will present persistent information such as the time of day. Thus, when the display 102 is an always-on display, at least a portion of the display will be capable of presenting information to a user even when the electronic device 100 is in a low-power or sleep mode.

The explanatory electronic device 100 of FIG. 1 includes a housing 101. In one embodiment, the housing 101 includes two housing members. A front housing member 127 is disposed about the periphery of the display 102. Said differently, the display 102 is disposed along a front major face of the front housing member 127 in one embodiment. A rear-housing member 128 forms the backside of the electronic device 100 in this illustrative embodiment and defines a rear major face of the electronic device. Features can be incorporated into the housing members 127,128. Examples of such features include an optional camera 129 or an optional speaker port 132, which are show disposed on the rear major face of the electronic device 100 in this embodiment. In this illustrative embodiment, a user interface component 114, which may be a button or touch sensitive surface, can also be disposed along the rear-housing member 128.

In one embodiment, the electronic device 100 includes one or more connectors 112,113, which can include an analog connector, a digital connector, or combinations thereof. In this illustrative embodiment, connector 112 is an analog connector disposed on a first edge, i.e., the top edge, of the electronic device 100, while connector 113 is a digital connector disposed on a second edge opposite the first edge, which is the bottom edge in this embodiment.

A block diagram schematic 115 of the electronic device 100 is also shown in FIG. 1. In one embodiment, the electronic device 100 includes one or more processors 116. In one embodiment, the one or more control circuit can include an application processor and, optionally, one or more auxiliary processors. One or both of the application processor or the auxiliary processor(s) can include one or more processors. One or both of the application processor or the auxiliary processor(s) can be a microprocessor, a group of processing components, one or more Application Specific Integrated Circuits (ASICs), programmable logic, or other type of processing device. The application processor and the auxiliary processor(s) can be operable with the various components of the electronic device 100. Each of the application processor and the auxiliary processor(s) can be configured to process and execute executable software code to perform the various functions of the electronic device 100. A storage device, such as memory 118, can optionally store the executable software code used by the one or more processors 116 during operation.

In this illustrative embodiment, the electronic device 100 also includes a communication circuit 125 that can be configured for wired or wireless communication with one or more other devices or networks. The networks can include a wide area network, a local area network, and/or personal area network. Examples of wide area networks include GSM, CDMA, W-CDMA, CDMA-2000, iDEN, TDMA, 2.5 Generation 3GPP GSM networks, 3rd Generation 3GPP WCDMA networks, 3GPP Long Term Evolution (LTE) networks, and 3GPP2 CDMA communication networks, UMTS networks, E-UTRA networks, GPRS networks, iDEN networks, and other networks. The communication circuit 125 may also utilize wireless technology for communication, such as, but are not limited to, peer-to-peer or ad hoc communications such as HomeRF, Bluetooth and IEEE 802.11 (a, b, g or n); and other forms of wireless communication such as infrared technology. The communication circuit 125 can include wireless communication circuitry, one of a receiver, a transmitter, or transceiver, and one or more antennas 126.

In one embodiment, the one or more processors 116 can be responsible for performing the primary functions of the electronic device 100. For example, in one embodiment the one or more processors 116 comprise one or more circuits operable to present presentation information, such as images, text, and video, on the display 102. The executable software code used by the one or more processors 116 can be configured as one or more modules 120 that are operable with the one or more processors 116. Such modules 120 can store instructions, control algorithms, and so forth.

In one embodiment, the one or more processors 116 are responsible for running the operating system environment 121. The operating system environment 121 can include a kernel, one or more drivers, and an application service layer 123, and an application layer 124. The operating system environment 121 can be configured as executable code operating on one or more processors or control circuits of the electronic device 100.

The application layer 124 can be responsible for executing application service modules. The application service modules may support one or more applications or "apps." Examples of such applications shown in FIG. 1 include a cellular telephone application 103 for making voice telephone calls, a web browsing application 104 configured to allow the user to view webpages on the display 102 of the electronic device 100, an electronic mail application 105 configured to send and receive electronic mail, a photo application 106 configured to permit the user to view images or video on the display 102 of electronic device 100, and a camera application 107 configured to capture still (and optionally video) images. These applications are illustrative only, as others will be obvious to one of ordinary skill in the art having the benefit of this disclosure.

In one or more embodiments, the one or more processors 116 are responsible for managing the applications and all secure information of the electronic device 100. The one or more processors 116 can also be responsible for launching, monitoring and killing the various applications and the various application service modules. The applications of the application layer 124 can be configured as clients of the application service layer 123 to communicate with services through application program interfaces (APIs), messages, events, or other inter-process communication interfaces. Where auxiliary processors are used, they can be used to execute input/output functions, actuate user feedback devices, and so forth.

In one embodiment, the one or more processors 116 may generate commands based on information received from one or more proximity sensors 108 and one or more other sensors 109. The one or more other sensors 109, in one embodiment, include an acoustic detector 133. One example of an acoustic detector 133 is a microphone. The one or more processors 116 may process the received information alone or in combination with other data, such as the information stored in the memory 118. For example, the one or more processors 116 may retrieve information the memory 118 to calibrate the sensitivity of the one or more proximity sensors 108 and one or more other sensors 109.

The one or more proximity sensors 108 are to detect the presence of nearby objects before those objects contact the electronic device 100. Illustrating by example, some proximity sensors emit an electromagnetic or electrostatic field. A receiver then receives reflections of the field from the nearby object. The proximity sensor detects changes in the received field to detect positional changes of nearby objects based upon changes to the electromagnetic or electrostatic field resulting from the object becoming proximately located with a sensor.

In one embodiment, the one or more processors 116 employ the one or more proximity sensors 108 to manage power consumption of audio and video components of the electronic device 100. For example, the one or more proximity sensors 108 may detect that the electronic device 100 is proximately located with a user's face and disable the display 102 to save power. In another example, when the one or more processors 116 determine that the electronic device 100 is proximately located with a user's face, the one or more processors 116 may reduce the volume level of the speaker 132 so as not to over stimulate the user's eardrums.

Other user input devices 110 may include a video input component such as an optical sensor, another audio input component such as a microphone, and a mechanical input component such as button or key selection sensors, touch pad sensor, touch screen sensor, capacitive sensor, motion sensor, and switch. Similarly, the other components 111 can include output components such as video, audio, and/or mechanical outputs. For example, the output components may include a video output component such as the display 102 or auxiliary devices including a cathode ray tube, liquid crystal display, plasma display, incandescent light, fluorescent light, front or rear projection display, and light emitting diode indicator. Other examples of output components include audio output components such as speaker port 132 or other alarms and/or buzzers and/or a mechanical output component such as vibrating or motion-based mechanisms.

In one embodiment, the proximity sensors 108 can include at least two sets 122,123 of proximity sensors components. For example, a first set 122 of proximity sensor components can be disposed on the front major face of the electronic device 100, while another set 123 of proximity sensor components can be disposed on the rear major face of the electronic device 100. In one embodiment each set 122,123 of proximity sensor components comprises at least two proximity sensor components. In one embodiment, the two proximity sensor components comprise a first component and a second component. For example, the first component can be one of a signal emitter or a signal receiver, while the second component is another of the signal emitter or the signal receiver.

Each proximity sensor component can be one of various types of proximity sensors, such as but not limited to, capacitive, magnetic, inductive, optical/photoelectric, laser, acoustic/sonic, radar-based, Doppler-based, thermal, and radiation-based proximity sensors. For example, each set 122,123 of proximity sensor components be an infrared proximity sensor set that uses a signal emitter that transmits a beam of infrared (IR) light, and then computes the distance to any nearby objects from characteristics of the returned, reflected signal. The returned signal may be detected using a signal receiver, such as an IR photodiode to detect reflected light emitting diode (LED) light, responding to modulated IR signals, and/or triangulation.

The other components 111 may include, but are not limited to, accelerometers, touch sensors, surface/housing capacitive sensors, audio sensors, and video sensors (such as a camera). For example, an accelerometer may be embedded in the electronic circuitry of the electronic device 100 to show vertical orientation, constant tilt and/or whether the device is stationary. Touch sensors may used to indicate whether the device is being touched at side edges 130,131, thus indicating whether or not certain orientations or movements are intentional by the user.

Other components 111 of the electronic device can also include a device interface to provide a direct connection to auxiliary components or accessories for additional or enhanced functionality and a power source, such as a portable battery, for providing power to the other internal components and allow portability of the electronic device 100.

It is to be understood that FIG. 1 is provided for illustrative purposes only and for illustrating components of one electronic device 100 in accordance with embodiments of the disclosure, and is not intended to be a complete schematic diagram of the various components required for an electronic device. Therefore, other electronic devices in accordance with embodiments of the disclosure may include various other components not shown in FIG. 1, or may include a combination of two or more components or a division of a particular component into two or more separate components, and still be within the scope of the present disclosure.

As noted above, the electronic device 100 of FIG. 1 can be used to help minimize false triggering events. This is particularly useful when the display 102 is an always-on display. This minimization of false triggering results in longer battery life and an enhanced user experience.

In one embodiment, the reduction in false triggering events is due to the requirement that a predefined audio signal or marker be received to confirm user input, such as voice input or touch input. In one embodiment, the predefined audio signal or marker is delivered by user's finger snap or series of finger snaps. Embodiments of the disclosure contemplate that most anyone can snap their fingers, and accordingly, using a finger snap or pattern of finger snaps as the predefined audio signal or marker provides a universal mechanism with which users can confirm user input.

In one embodiment, the predefined audio signal or marker is initially captured by the acoustic detector 133 and stored at a location within the memory 118 of the electronic device 100. Following this one time event, once the proximity sensors 108 detect the presence of an individual, or alternatively, the proximity of an individual to the electronic device 100, the one or more processors 116 can monitor the acoustic detector 133 for the predefined audio signal or marker, which in one embodiment is associated with a finger snap (or a pattern of finger snaps), to confirm user input. Provided that the audio signal or marker is detected and are validated to be comparable to the stored audio signals described earlier, the user input can be confirmed. As an illustrative example, when the snaps are received, an always-on display can be enabled to display the stored messages/notifications to the user.

Figure 2:
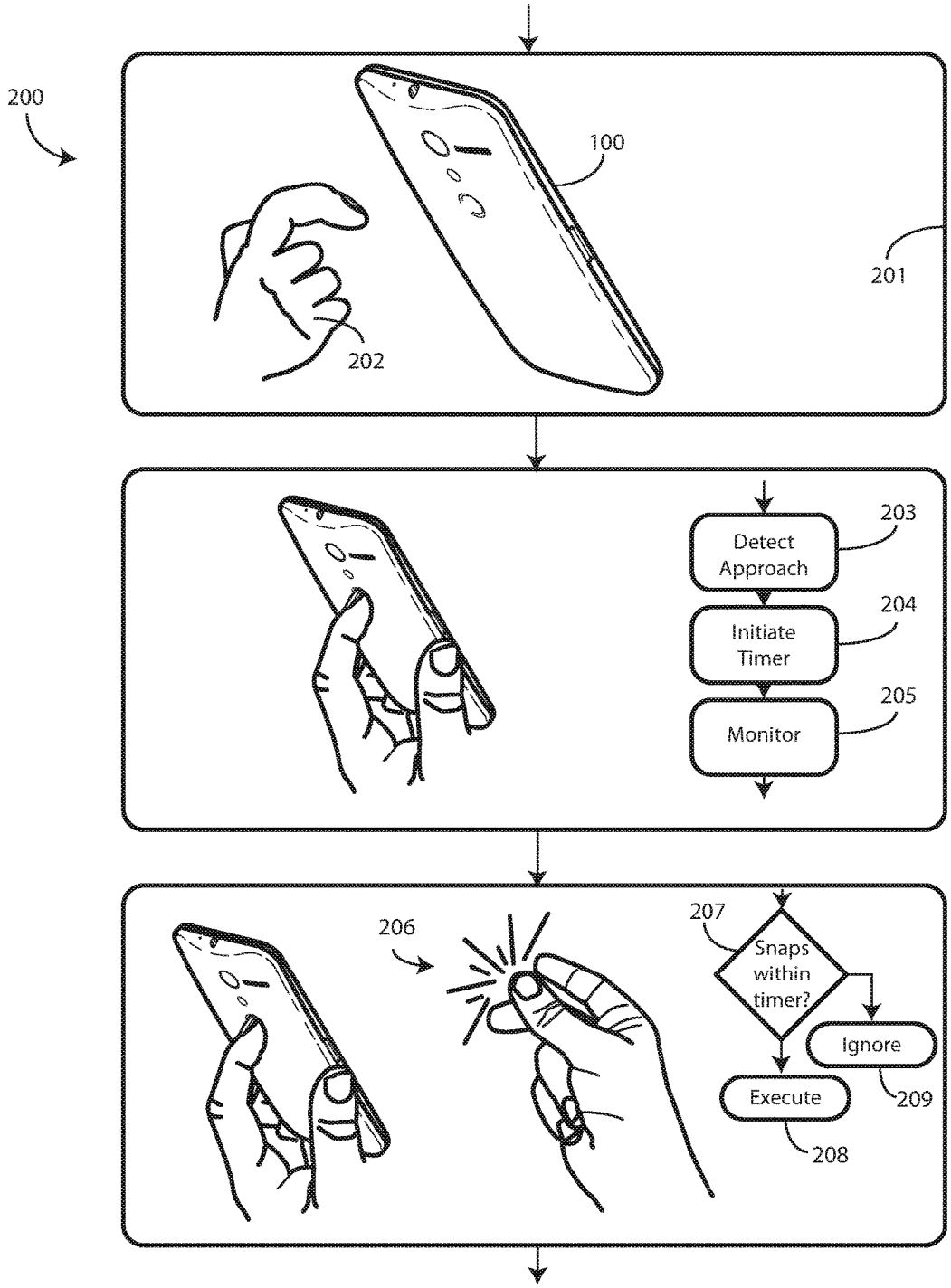
FIG. 2 illustrates one explanatory method for an electronic device configured in accordance with one or more embodiments of the disclosure.

Turning now to FIG. 2, illustrated therein is a method 200 of controlling an electronic device 100 configured in accordance with one or more embodiments of the disclosure. At step 201, the electronic device 100 is in a low-power or sleep mode. This particular illustrative electronic device 100 includes a display (102) that is an always-on display. Thus, as shown at step 201, the electronic device 100 may be positioned, for example, in a stand on a bedside table. Despite being in the low-power or sleep mode, the electronic device 100 can serve as a clock due to the fact that the always-on display can provide time of day information, weather information, and so forth, on a portion of its screen.

At step 201, a user is reaching for the electronic device 100. The user's hand 202 is moving toward the electronic device 100. In one embodiment, the one or more proximity sensors (108) detect this and deliver signals to the one or more processors (116) of the electronic device. The one or more processors (116) thus, at step 203, receive sensor data from the one or more proximity sensors (108). The sensor data includes information corresponding to an object, which is the user's hand 202 in this embodiment, approaching the rear housing rear-housing member (128).

Where this occurs, in one embodiment, at step 204, the one or more processors (116) of the electronic device 100 initiate a timer in response to the object approaching the housing. While the timer is running, at step 205 the one or more processors (116) of the electronic device monitor the acoustic detector (133) for acoustic data corresponding to a predefined acoustic signal or marker.

In this illustrative embodiment, the predefined acoustic signal or marker comprises one or more finger snaps 206. While one or more finger snaps 206 is one example of a predefined acoustic signal or marker, others will be obvious to those of ordinary skill in the art having the benefit of this disclosure. For example, in another embodiment, the predefined acoustic marker or signal may be a whistle or whistle pattern. In another embodiment, the predefined acoustic marker or signal may be one or more handclaps. In yet another embodiment, the predefined acoustic marker or signal may be one or more foot stomps. In yet another embodiment, the predefined acoustic marker or signal may be a predefined code word or words.

While any of a number of acoustic signals or markers can be used with embodiments of the disclosure, preferred acoustic signals or markers have two characteristics: first, they are not commonly heard in ordinary ambient environments. Second, they are universally easy to generate. For example, most users of electronic devices can snap. However, the unique sound made by one or more finger snaps 206 is not one that commonly occurs in a typical environment. For this reason, one or more finger snaps 206 are well suited for use with embodiments of the disclosure. Similarly, where a code word is used as the predefined acoustic marker or signal, it should be a word that is not commonly heard in ordinary conversation. Examples of such words include "marshmallow" and "Buster" and "beanie." Others will be obvious to those of ordinary skill in the art having the benefit of this disclosure.

In the illustrative embodiment of FIG. 2, the predefined acoustic signal or marker is one or more finger snaps 206. Accordingly, at step 205, the one or more processors (116) of the electronic device 100 monitor the acoustic detector (133) for acoustic data corresponding to one or more finger snaps 206.

At decision 207, the one or more processors (116) of the electronic device 100 determine whether the one or more finger snaps 206 occurred, and more particularly whether the one or more finger snaps 206 occurred prior to expiration of the timer initiated at step 204. Where the one or more finger snaps 206 occur prior to expiration of the timer, at step 208 the one or more processors (116) of the electronic device 100 perform an operation of the electronic device 100. For example, in the embodiment of FIG. 2, where the display (102) of the electronic device 100 is an always-on display, the operation performed at step 208 can be activating the display (102). By requiring both the detection of the object, i.e., the user's hand 202, approaching the electronic device 100, and the confirmation provided by the one or more snaps 206 occurring prior to expiration of the timer initiated at step 204, embodiments of the disclosure prevent false triggering of the always-on display, thereby saving battery capacity and extending run time. Where the one or more snaps 206 fail to occur prior to expiration of the timer, in one embodiment the one or more processors (116) of the electronic device 100 can ignore any detected sensor data at step 209.

Figure 3:
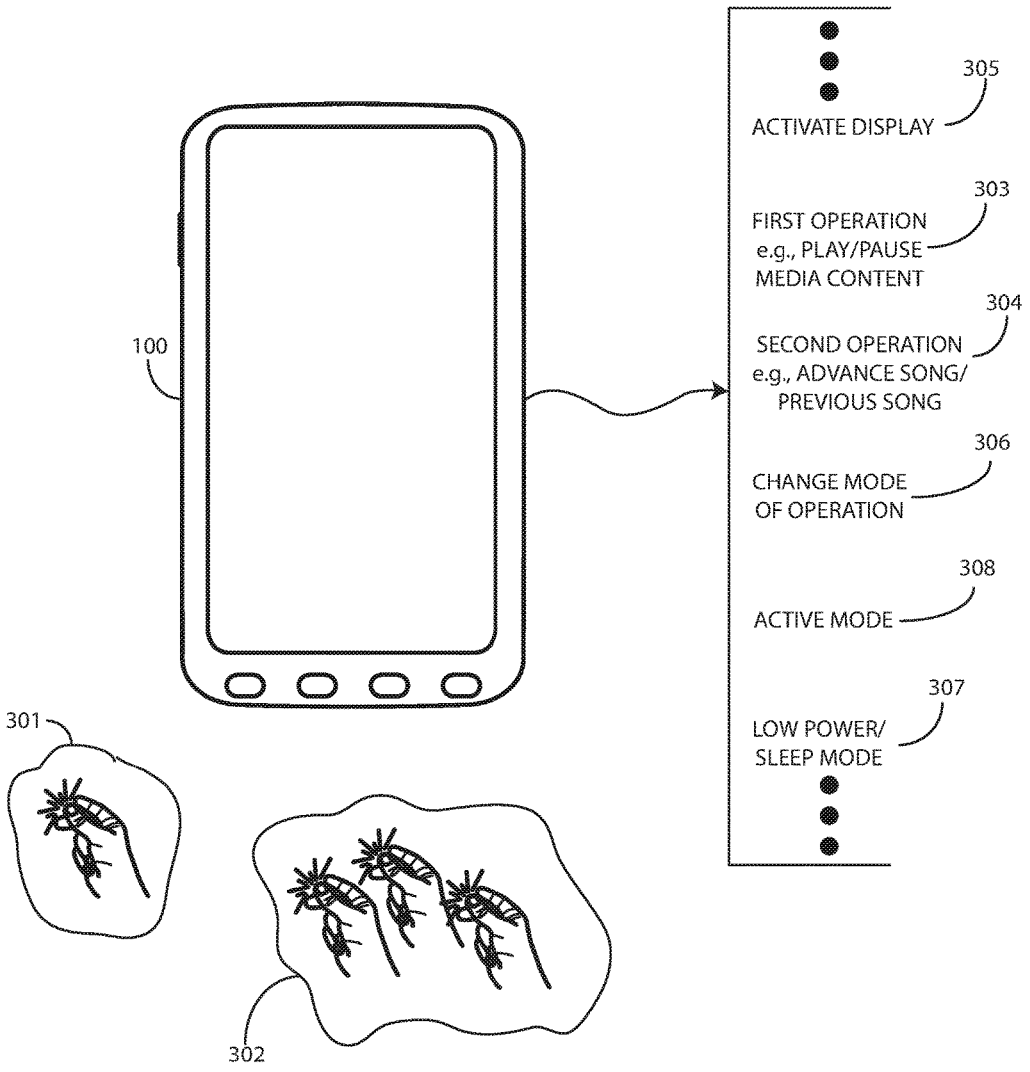
FIG. 3 illustrates explanatory operations that can be performed in an electronic device in accordance with one or more methods of the disclosure.

Activation of an always-on display is but one example of an operation that can be performed by the one or more processors (116) of the electronic device 100. Turning to FIG. 3, illustrated therein are a number of others. Each is an example only, as numerous other operations will be obvious to those of ordinary skill in the art having the benefit of this disclosure.

As noted above, in one embodiment, where the one or more finger snaps 206 occur prior to expiration of the timer, the one or more processors (116) of the electronic device 100 can activate a display 305. In another embodiment, where the one or more finger snaps 206 occur prior to expiration of the timer, the one or more processors (116) of the electronic device 100 can change a mode of operation of the electronic device 306. For example, when the electronic device 100 is operating in a media player mode of operation, where the one or more finger snaps 206 occur prior to expiration of the timer, the one or more processors (116) of the electronic device 100 can change the electronic device 100 to a telephone mode of operation. Alternatively, the change in mode can comprise transitioning the electronic device 100 from a low-power or sleep mode 307 to an active mode 308 of operation.

It should be noted that the one or more snaps 206 can comprise a single snap in one embodiment. In another embodiment, the one or more snaps 206 comprise a plurality of snaps. In yet another embodiment, the one or more snaps 206 comprise a pattern of snaps. In one embodiment, different numbers or patterns of snaps can be used to control different operations of the electronic device 100. FIG. 3 illustrates a few different operations and an illustration of how different quantities or patterns of snaps can be used in this fashion.

In one embodiment, when the one or more finger snaps (206) comprise a single snap 301, and the single snap occurs prior to the expiration of a timer, the one or more processors (116) of the electronic device 100 can perform a first operation. Where the one or more finger snaps (206) comprise a plurality of snaps 302, the one or more processors (116) of the electronic device 100 can perform a second operation. In one embodiment, the first operation and second operation are the same. The fact that the operation is to be repeated is confirmed by a different number of snaps. In another embodiment, the first operation and the second operation are different. The difference in operations can be confirmed by the different number of snaps.

Illustrating by example, in one embodiment the first operation comprises one of starting or stopping the playback of media content 303. For instance, when the electronic device 100 is in a media player mode, a user may start playback of a song by approaching the housing (101) of the electronic device 100 with their hand and snapping once. Similarly, when the music is playing, the user may stop playback of the song by approaching the housing (101) of the electronic device 100 and then delivering a single snap prior to the expiration of a timer.

However, in this illustration the second operation, which is indicated by the plurality of snaps 302, is different from the first operation. For example, the second operation may be selecting a new song 304. Accordingly, a user may select a song, e.g., advance to the next song, by approaching the housing (101) of the electronic device 100 with their hand and snapping a plurality of times.

While this example used the quantity of snaps to distinguish the operations occurring, it should be noted that a pattern could also be used to distinguish operations. Using musical notation for illustrative purposes, a first pattern of four quarter-note snaps at a tempo of 72 beats per minute may comprise a first pattern, in which the one or more processors (116) of the electronic device 100 perform a first operation. By contrast, two beats of triplet eighth notes at the same tempo may constitute a second pattern, in which the one or more processors (116) of the electronic device 100 perform a second operation, and so forth.

Figure 4:
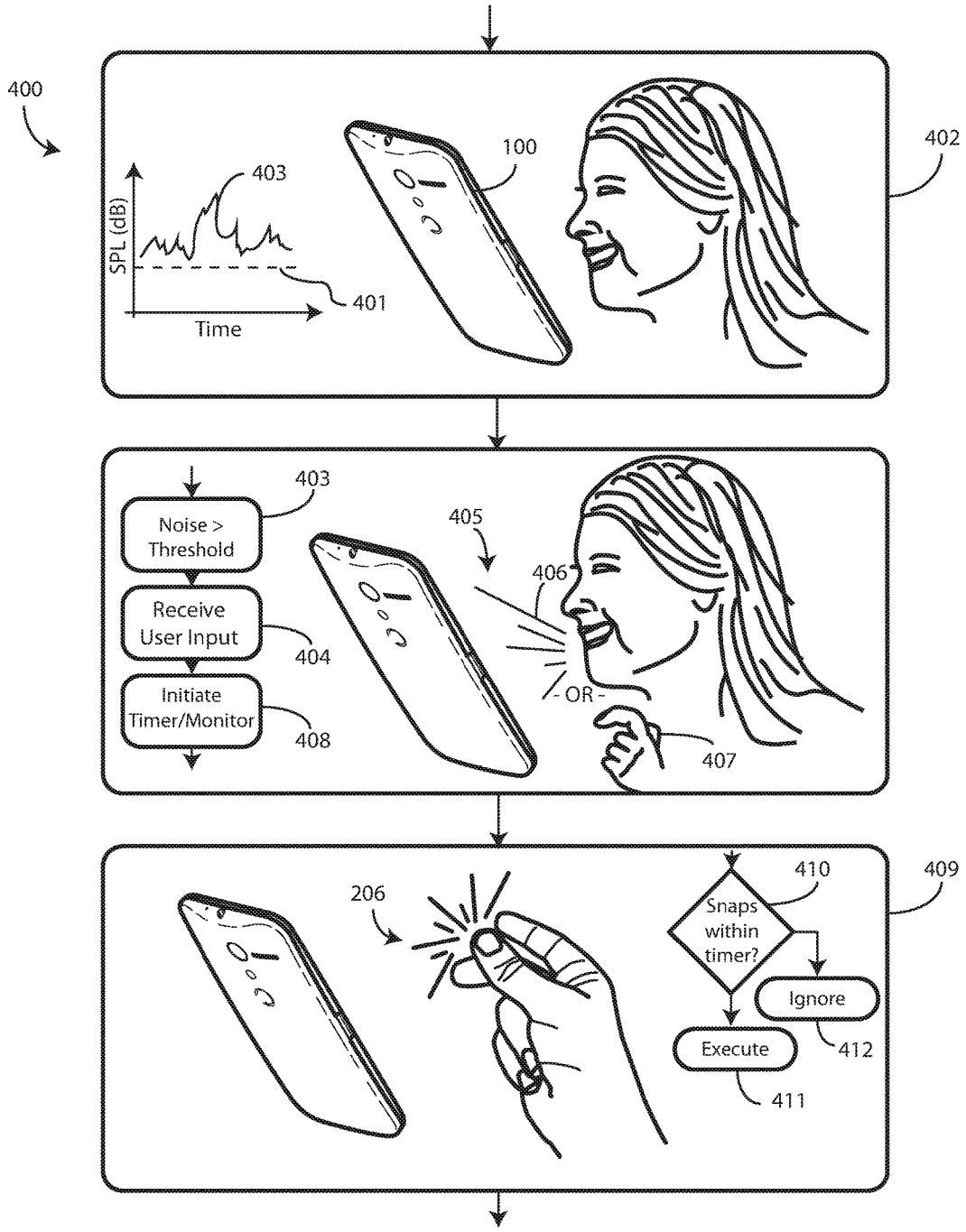
FIG. 4 illustrates one explanatory method for an electronic device configured in accordance with one or more embodiments of the disclosure.

Turning now to FIG. 4, illustrated therein is yet another method 400 suitable for an electronic device 100 configured in accordance with one or more embodiments of the disclosure. The method 400 of FIG. 4 contemplates that in some environments, conventional user input techniques such as providing touch or voice commands will be sufficient to control the electronic device 100. However, in other environments it may be desirable to add another layer of user interface protection to prevent false triggering. For example, in a noisy environment where the user input comprises voice commands, the ambient noise may falsely trigger a user interface. Similarly, in very bumpy or jostled environments, such as riding in a car, where the user input comprises touch input, false triggering may occur as well.

To accommodate both normal and "elevated stimulus" environments, in one embodiment the one or more processors (116) of the electronic device 100 monitor other sensors (109) to see if certain conditions exceed a predetermined threshold 401. Where they do, in one embodiment the one or more processors (116) of the electronic device 100 require the receipt of a predefined acoustic signal or marker to confirm user input.

In the illustrative embodiment of FIG. 4, at step 402, the one or more processors (116) of the electronic device 100 receive ambient noise data 403 from the acoustic detector (133). At step 403, where the ambient noise data 403 is above a predetermined threshold 401, such as 50 dB, the one or more processors (116) of the electronic device 100 require an acoustic signal or marker confirmation of any user input due to the fact that the electronic device 100 is in a noisy environment. Where the ambient noise data 403 is below the predetermined threshold, the one or more processors (116) of the electronic device 100 may simply perform the operation without any such confirmation.

At step 404, the one or more processors (116) of the electronic device 100 receive user input 405. The user input 405 can be any of a variety of forms of input. Two examples are provided in FIG. 4. In one embodiment, the user input 405 comprises voice commands 406. In another embodiment, the user input 405 comprises touch input 407.

Continuing with the noisy environment example, presume that the user input 405 comprises voice commands 406. In one embodiment, after receiving the user input 405 at step 404, the one or more processors (116) optionally initiate a timer and monitor the acoustic detector (133) at step 408 for a predefined acoustic marker or signal. In this embodiment, the predefined acoustic marker or signal is one or more finger snaps 206. Accordingly, the one or more processors (116) of the electronic device 100 monitor the acoustic detector (133) for acoustic data indicating detection of the one or more finger snaps 206.

Where the one or more finger snaps 206 occur, as shown at step 409, the one or more processors (116) of the electronic device 100 can perform the operation identified by the user input 405 at step 411. Where the optional timer was started at step 408, the one or more processors (116) of the electronic device 100 may perform the operation, in one embodiment, only if the one or more snaps 206 occurred prior to the expiration of the timer, as indicated at decision 410. If the one or more snaps 206 fail to occur, or alternatively if they fail to occur prior to the expiration of the optional timer, the one or more processors (116) can ignore the user input 405. Accordingly, any false user input not intended for the electronic device 100 can be ignored at step 412 because it was not confirmed by the delivery of the one or more fingers snaps 206 in this embodiment.

While noise was used as an example, motion could have been monitored as well. For instance, in another embodiment, the steps of FIG. 4 could be repeated, but with the comparison of an amount of motion detected by the other sensors (109) being compared to a threshold rather than ambient noise. Thus, in another embodiment, touch input 407 may need to be confirmed with an acoustic signal or marker when motion of the electronic device 100 exceeds a predefined threshold 401 such as 1.5 G.

Figure 5:
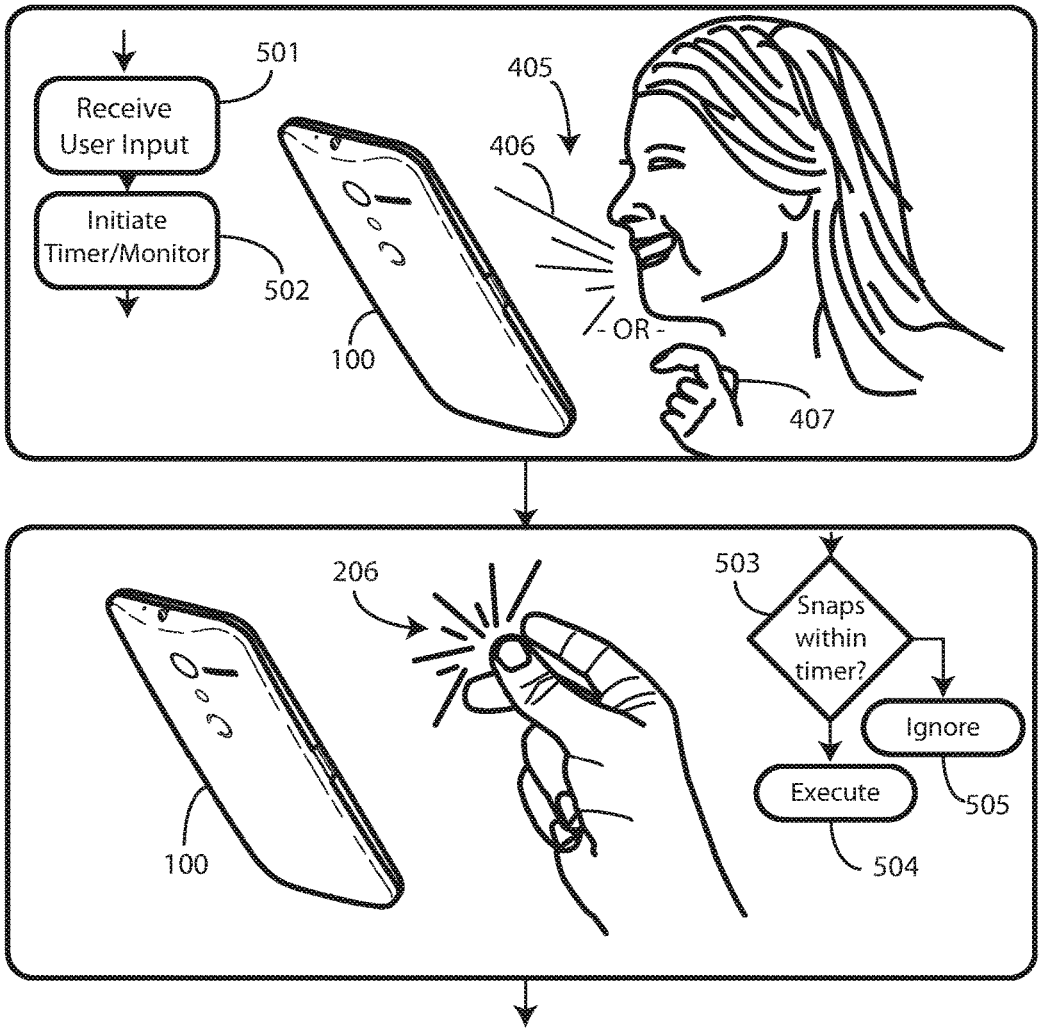
FIG. 5 illustrates one explanatory method for an electronic device configured in accordance with one or more embodiments of the disclosure.

Turning now to FIG. 5, illustrated therein is yet another method 500 suitable for an electronic device 100 configured in accordance with one or more embodiments of the disclosure. Embodiments of the disclosure contemplate that some users are interesting in minimizing false triggering of user input as much as possible. In the embodiment of FIG. 5, an acoustic confirmation of all user input is required for the one or more processors (116) of the electronic device 100 to perform an operation.

At step 501, the one or more processors (116) of the electronic device 100 receive user input 405 corresponding to an operation of the electronic device 100. As with the embodiment of FIG. 4, the user input 405 can comprise voice commands 406, i.e., voice input, touch input 407, or combinations thereof. In one embodiment, in response to receiving the user input 405, the one or more processors (116) of the electronic device 100 initiate a timer at step 502. At step 502, the one or more processors (116) of the electronic device 100 also monitor the acoustic detector (133) for acoustic data indicating the detection of an acoustic signal or marker, such as one or more finger snaps 206.

At decision 503, the one or more processors (116) of the electronic device 100 determine whether the one or more finger snaps 206 occur prior to the expiration of the timer. In one embodiment, where they do, the one or more processors (116) of the electronic device 100 can perform the operation corresponding to the user input 405 at step 504. Where they do not, or alternatively where the one or more finger snaps 206 do not occur at all, the one or more processors (116) of the electronic device 100 can ignore the user input 405 and not perform the corresponding operation at step 505. For example, in one embodiment where the one or more finger snaps 206 are received prior to expiration of the timer, the one or more processors can change a mode of operation from a first mode to a second mode in response to the user input 405. If the first mode were a low-power or sleep mode, the one or more processors (116) of the electronic device 100 may wake the device and transition it to an operational mode. As noted above, this is but one example of an operation that can be performed in accordance with this embodiment.

In another embodiment, as noted above, the user can configure the electronic device 100 to work in the opposite, i.e., where the one or more finger snaps 206 cancel the user input 405 rather than confirm it. This mode reverses step 504 and step 505 such that where the one or more finger snaps 206 occur prior to expiration of the timer, the one or more processors (116) of the electronic device 100 can cancel the operation corresponding to the user input 405 at step 505. Where they do not occur prior to expiration of the timer, or alternatively where the one or more finger snaps 206 do not occur at all, the one or more processors (116) of the electronic device 100 can execute the operation in response to the user input 405 at step 504. For example, if the user input is in the form of voice commands 406, and the electronic device 100 incorrectly recognizes the voice commands 406, the delivery of the one or more finger snaps 206 would end the process, similar to the user saying the words "cancel," or otherwise manually terminating the operation.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. An electronic device, comprising:

an acoustic detector; and one or more processors operably coupled to the acoustic detector, wherein the one or more processors are configured to:

receive ambient noise data provided by the acoustic detector;

receive user input corresponding to an operation of the electronic device, wherein the user input comprises at least one voice command that indicates the operation of the electronic device;

after receiving the user input, initiate a timer;

compare the ambient noise data to a noise threshold;

determine whether the ambient noise data exceeds the noise threshold;

responsive to determining that the ambient noise data exceeds the noise threshold, monitor an output of the acoustic detector for receipt of acoustic data that indicates a predefined acoustic signal to confirm the user input; and responsive to receiving the acoustic data provided by the acoustic detector that indicates the predefined acoustic signal prior to expiration of the timer, perform the operation of the electronic device that corresponds to the user input.

2. The electronic device of claim 1, further comprising:

one or more proximity sensor components operably coupled to the one or more processors, wherein the one or more processors are further configured to receive sensor data provided by the one or more proximity sensor components, the sensor data indicating that an object is approaching the one or more proximity sensor components.

3. The electronic device of claim 2, wherein the one or more processors are configured to receive the sensor data provided by the one or more proximity sensor components prior to receiving the user input that corresponds to the operation of the electronic device.

4. The electronic device of claim 1, further comprising:

a display, wherein the one or more processors are configured to perform the operation of the electronic device at least by activating the display.

5. The electronic device of claim 1, wherein the one or more processors are configured to perform the operation of the electronic device at least by starting or stopping playback of media content that is output by the electronic device.

6. The electronic device of claim 1, wherein the predefined acoustic signal comprises at least one finger snap, at least one clap, or at least one whistle.

7. The electronic device of claim 1, wherein the acoustic detector comprises one or more microphones.

8. The electronic device of claim 1, wherein the one or more processors are configured to receive the user input corresponding to the operation of the electronic device after determining that the ambient noise data exceeds the noise threshold.

9. A method comprising:

receiving, by an electronic device, ambient noise data provided by an acoustic detector;

receiving, by the electronic device, user input corresponding to an operation of the electronic device, wherein the user input comprises at least one voice command that indicates the operation of the electronic device;

after receiving the user input, initiating a timer;

comparing, by the electronic device, the ambient noise data to a noise threshold;

determining whether the ambient noise data exceeds the noise threshold;

responsive to determining that the ambient noise data exceeds the noise threshold, monitoring, by the electronic device, an output of the acoustic detector for receipt of acoustic data that indicates a predefined acoustic signal to confirm the user input; and responsive to receiving the acoustic data provided by the acoustic detector that indicates the predefined acoustic signal prior to expiration of the timer, performing, by the electronic device, the operation of the electronic device that corresponds to the user input.

10. The method of claim 9, further comprising:

receiving, by the electronic device, sensor data provided by one or more proximity sensor components, the sensor data indicating that an object is approaching the one or more proximity sensor components.

11. The method of claim 10, wherein receiving the sensor data provided by the one or more proximity sensor components comprises receiving, by the electronic device, the sensor data prior to receiving the user input that corresponds to the operation of the electronic device.

12. The method of claim 9, wherein performing the operation of the electronic device that corresponds to the user input comprises activating a display.

13. The method of claim 9, wherein performing the operation of the electronic device that corresponds to the user input comprises starting or stopping playback of media content that is output by the electronic device.

14. The method of claim 9, wherein the predefined acoustic signal comprises at least one finger snap, at least one clap, or at least one whistle.

15. The method of claim 9, wherein the acoustic detector comprises one or more microphones.

16. The method of claim 9, wherein receiving the user input corresponding to the operation of the electronic device occurs after determining that the ambient noise data exceeds the noise threshold.

* * * * *